US006994278B2

(12) United States Patent
Galvin et al.

(10) Patent No.: US 6,994,278 B2
(45) Date of Patent: Feb. 7, 2006

(54) DEVICE FOR SPRAYING WATER IN THE FORM OF A THIN-WALLED HOLLOW JET FOR THE FORMATION OF ARTIFICIAL SNOW

(75) Inventors: Michel Galvin, Carquefou (FR); Eric David, Treillieres (FR); Bernard Pergay, Francheville (FR)

(73) Assignee: York Neige, Sainte Luce sur Loire (FR)

( * ) Notice: Subject to any disclaimer, the term of this patent is extended or adjusted under 35 U.S.C. 154(b) by 139 days.

(21) Appl. No.: 10/629,789

(22) Filed: Jul. 30, 2003

(65) Prior Publication Data

US 2004/0112976 A1 Jun. 17, 2004

(30) Foreign Application Priority Data

Jul. 31, 2002 (FR) ..... 02 09720

(51) Int. Cl.

| | |
|---|---|
| ***B05B 1/26*** | (2006.01) |
| ***B05B 1/34*** | (2006.01) |
| ***B05B 1/32*** | (2006.01) |
| ***F25C 3/04*** | (2006.01) |

(52) U.S. Cl. ..... 239/461; 239/463; 239/473; 239/493; 239/537; 239/539; 239/589; 239/14.2

(58) Field of Classification Search ..... 239/461, 239/463, 473, 493, 537, 538, 539, 589, 579, 239/14.2, 433, 434.5, 424

See application file for complete search history.

(56) References Cited

U.S. PATENT DOCUMENTS

| | | | | |
|---|---|---|---|---|
| 3,908,903 | A * | 9/1975 | Burns, Jr. | 239/2.2 |
| 3,979,061 | A * | 9/1976 | Kircher | 239/2.2 |
| 4,353,504 | A * | 10/1982 | Girardin et al. | 239/14.2 |
| 4,682,729 | A * | 7/1987 | Doman et al. | 239/2.2 |
| 4,742,959 | A * | 5/1988 | Stanchak et al. | 239/14.2 |
| 5,090,619 | A | 2/1992 | Barthold et al. | |

FOREIGN PATENT DOCUMENTS

| | | |
|---|---|---|
| JP | 9-75808 | 3/1997 |
| WO | WO 94/10516 | 5/1994 |

* cited by examiner

*Primary Examiner*—Davis Hwu
(74) *Attorney, Agent, or Firm*—Young & Thompson

(57) ABSTRACT

The spraying device comprises: a tubular body which defines a chamber connected to a supply of water under pressure, a nozzle (1) with atomizer and a constriction organ in the form of a valve (6) in order to form a thin-walled hollow jet. The orifice (7) of the nozzle comprises a surface shaping the jet which is arranged to produce at the level of this latter an asymmetry of rotation. The spraying device preferably comprises two nozzles centered in the same plane and forming between them an angle which is of the order of 80°. The valves of these two nozzles are controlled simultaneously by appropriate elements.

10 Claims, 8 Drawing Sheets

DEVICE FOR SPRAYING WATER IN THE FORM OF A THIN-WALLED HOLLOW JET FOR THE FORMATION OF ARTIFICIAL SNOW

BACKGROUND OF THE INVENTION

The present invention relates to a device for spraying water under high pressure which is suitable for the formation of artificial snow.

There exist many devices for the production of artificial snow using procedures for spraying water or a mixture of air and water.

The present invention relates to a device which makes it possible to spray water in the form of a hollow jet, as described in the document FR-2-278 407 and suggests an improvement of the heat exchange capacity between the ambient air and the water sprayed under pressure.

The invention also suggests a compact spraying device capable of being adapted to atmospheric conditions, i.e. of offering the possibility of varying the flow rate of water under pressure and hence of increasing the quantity of snow produced.

SUMMARY OF THE INVENTION

According to the invention, the spraying device comprises: a tubular body which defines a chamber connected to an influx of water under pressure, a nozzle placed at the exit of the said chamber, equipped with an orifice forming an atomizer which extends from the neck of said nozzle and an organ of constriction in the form of a valve, arranged in the orifice of said nozzle to form the thin-walled hollow jet; this device is characterized by the fact that said orifice comprises a surface shaping the form of the hollow jet which is arranged to produce at the level of the latter, an asymmetry of rotation, surrounding the ejection axis.

According to a particular embodiment, the surface shaping of the jet comprises a truncated part which extends from the neck of the nozzle and which is followed by a discharge surface the angle of which in the axial plane changes according to a non-linear profile diminishing from upstream to downstream, and the axial length of which varies between a value of zero or almost zero with, at this place, a jet the exit angle of which corresponds to the angle of the said truncated part, and a value of the order of several millimeters, adapted to the choice of the exit angle desired for the jet, which angle is less than the angle of the truncated part.

According to a preferred arrangement of the invention, the aperture angle of the hollow jet is included between a value which is of the order of at least 60° and a value which may be less than 20°.

According to another arrangement of the invention, the surface shaping the hollow jet may comprise grooves which are oriented according to a plane passing through the axis of the nozzle. These grooves are arranged either at the level of the trailing edge of the nozzle or at the level of the neck of the said nozzle, and over a part of the length of the surface shaping the jet, i.e. of the truncated part of the orifice.

Still according to the invention, these grooves are positioned with an angular spacing included between 2° and 10°, of the order of 5° for example.

According to another disposition of the invention, the axial length of the grooves is such as to make it possible to maintain a flow rate when the valve is in the active closure position, i.e. when it is in contact with the surface shaping the hollow jet in the orifice.

Again according to the invention, the grooves made on the surface shaping the jet are obtained by machining by means of a disk-shaped milling cutter, the periphery of which forms an angle of 90°, and the milling cutter is positioned in a plane passing through the axis of the nozzle.

The spraying device according to the invention preferably comprises two nozzles which are linked to corresponding chambers fed with water under pressure, these nozzles are centered in the same plane and form between them an angle which is included between 60° and 100°, of the order of 80°; on the other hand, it comprises means to regulate the valves simultaneously, making it possible to vary at will the flow rate of the water to be sprayed under pressure.

Each valve is preferably adjustable by means of a screw nut system, i.e. that each valve comprises a part acting as controlling screw adjustable by means of a screw, and the valve is prevented from rotating by appropriate means, and each controlling screw is equipped with a toothed wheel which is geared to the same motorized endless screw, and this motorized screw makes possible the simultaneous control of the said valves.

Still according to the invention, the spraying device comprises nucleation means arranged close to the nozzles, and these nucleation means are fed with water under pressure, at the same time as the nozzles, and are fed with air under pressure.

The spraying device according to the invention comprises a single-piece body equipped with drill holes forming the influx chambers for water under pressure, these chambers are arranged to receive the spraying nozzles; the corresponding single-piece body is also equipped with drill holes for the installation of nucleation means, and these nucleation means are present in the form of cartridges screwed to the extremity of the said drill holes.

BRIEF DESCRIPTION OF THE DRAWINGS

But the invention will be described in still more detail by means of the following description and appended drawings, given for guidance, and in which.

DESCRIPTION OF THE PREFERRED EMBODIMENTS

Figure 1:
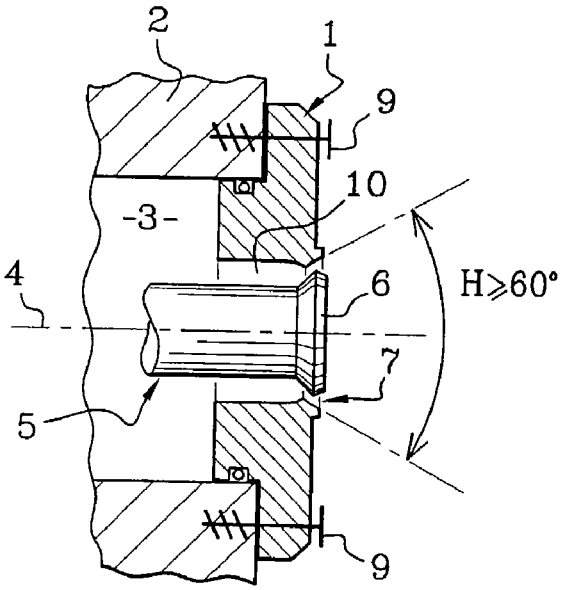
FIG. 1 represents the nozzle of the spraying device according to the invention as a horizontal section.
Figure 2:
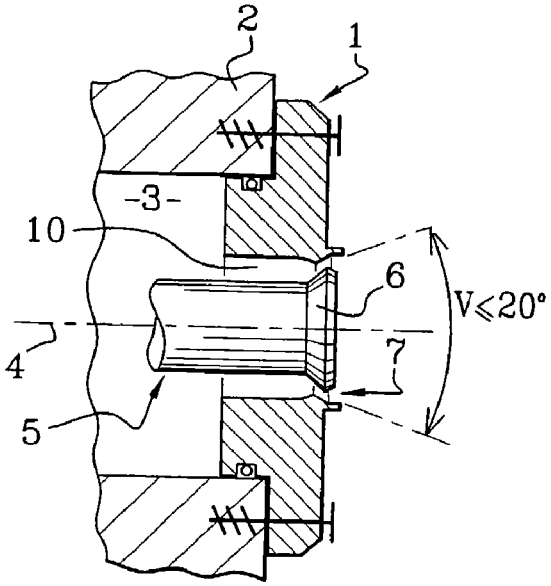
FIG. 2 represents the spraying nozzle as a vertical section.
Figure 14:
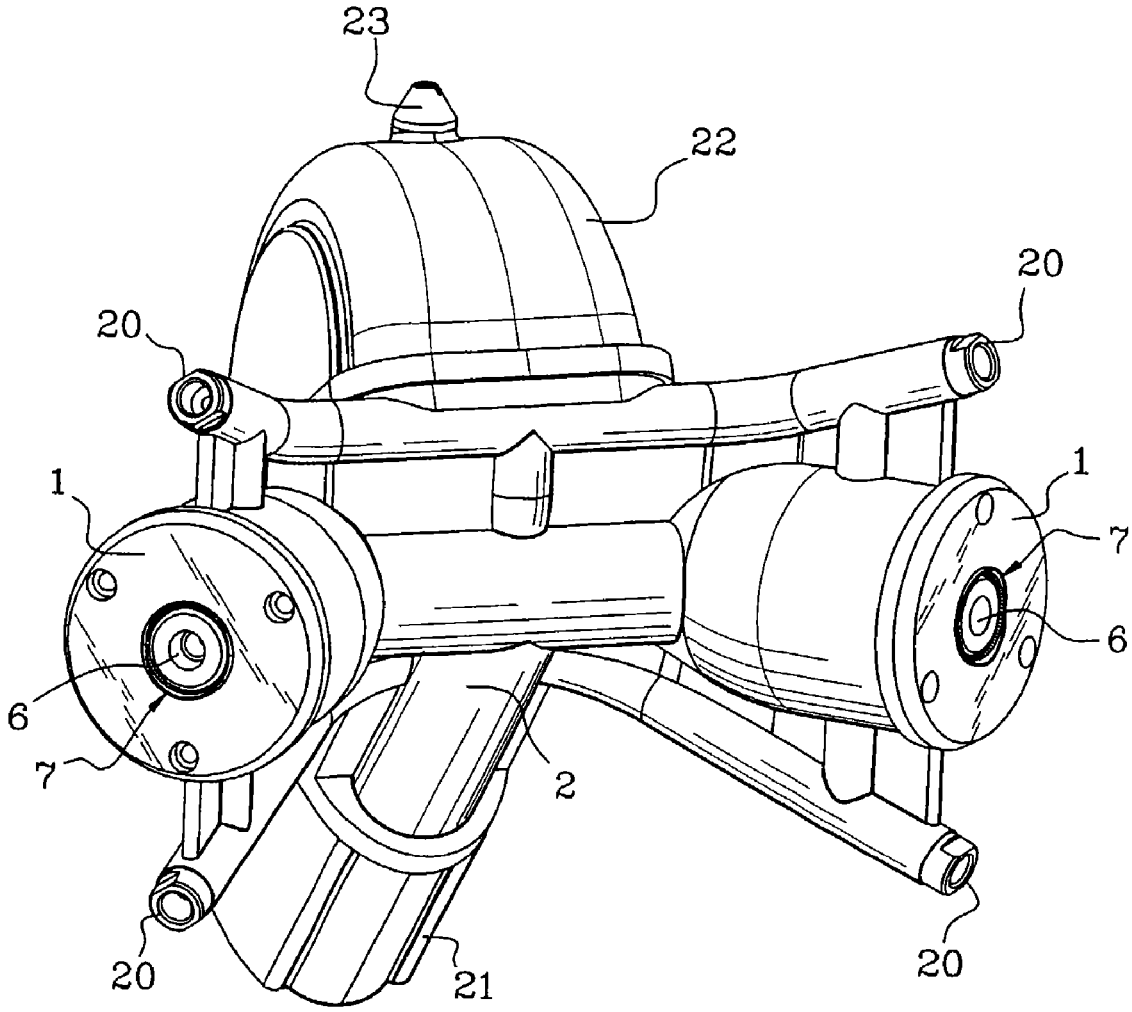
FIG. 14 is an isometric view of the complete spraying device according to the invention, comprising two spraying nozzles.

FIGS. 1 and 2 show the active spraying elements of the device which is represented and detailed further on, starting at FIG. 14.

These elements are constituted of a nozzle 1 installed on the body 2 of the device, at the extremity of chamber 3 in which water under pressure circulates.

This nozzle 1 is centered on the axis 4 of the body 2 and on this axis 4 a constriction organ is located the downstream extremity of which, presented in the form of a valve 6, is placed in the orifice 7 of said nozzle, as detailed for example in the document FR-2 278 407.

The nozzle exists in the form of a flange fixed to the body 2 by means of an appropriate screw 9.

Figure 3:
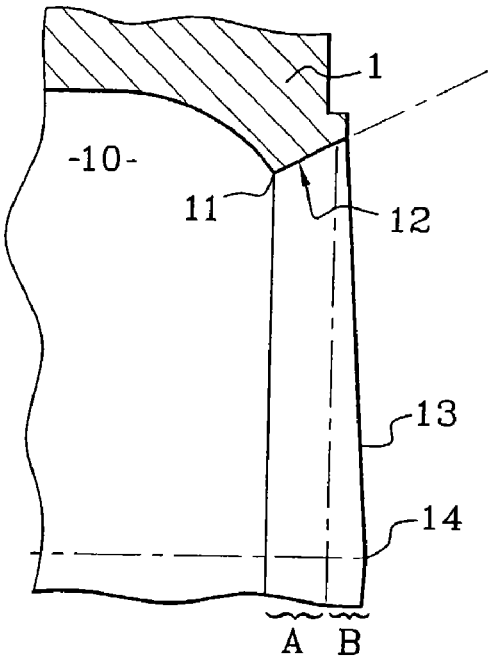
FIG. 3 is an enlarged horizontal sectional view of the atomizer of the spraying nozzle.
Figure 4:
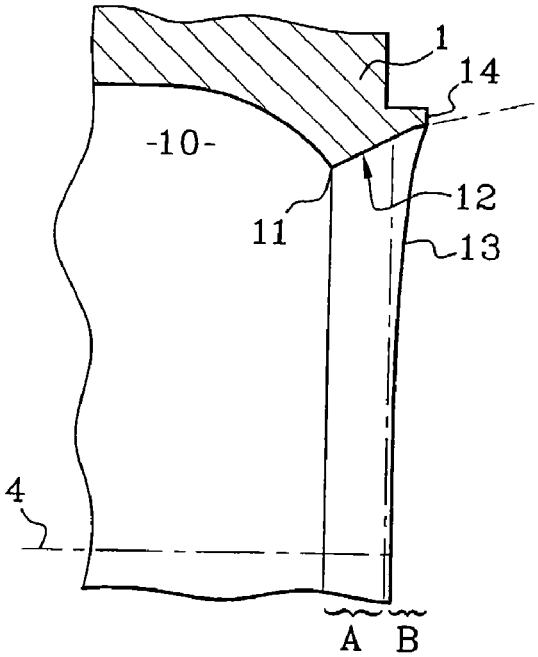
FIG. 4 is an enlarged vertical sectional view of the atomizer.

This nozzle 1 comprises, as shown in more details in FIGS. 3 and 4, a chamber 10 the downstream extremity of which is convergent so as to form a neck 11 which is followed by an atomizer 12 the surface of which makes possible the shaping of the jet. This atomizer 12 comprises two parts: a first part A, from the neck 11, which is a truncated form with an angle of the order of 60°, and a second part B, an extension of A up to the level of the trailing edge 13. The surface of this second part B is characterized by a profile in an axial plane which is not linear but which changes with an angle which will diminish from upstream to downstream. It is observed in FIG. 3 that the exit angle practically corresponds to the angle of part A of the atomizer and, as shown in FIG. 4, this angle diminishes to a value which may be of the order of 20° with respect to the ejection axis 4.

The FIGS. 1 and 2 illustrate this angle H, at the level of the horizontal section of the nozzle and the angle V at the level of the vertical section of this nozzle.

Figure 5:
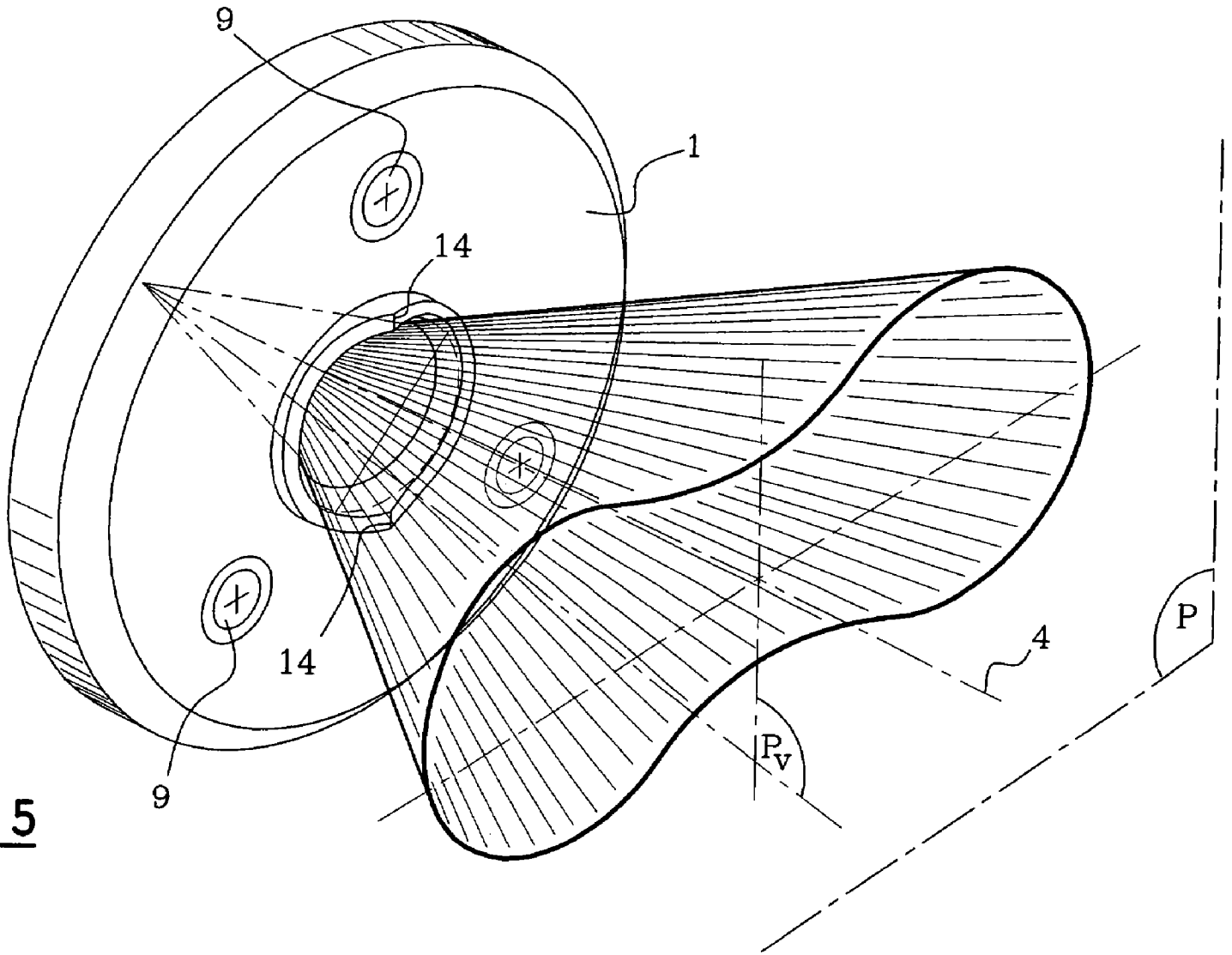
FIG. 5 represents the hollow jet at the outlet of the nozzle of the invention.
Figure 6:
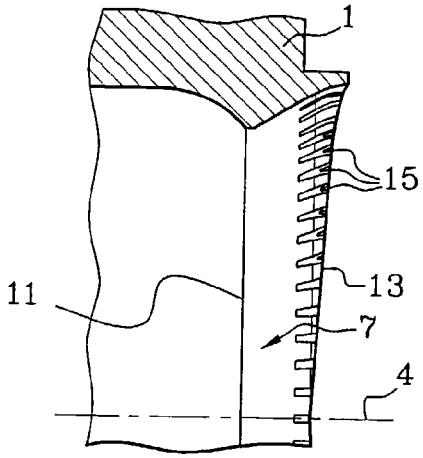
FIG. 6 represents an enlarged vertical section of a portion of the atomizer with an arrangement at the leakage edge in the form of striations.
Figure 7:
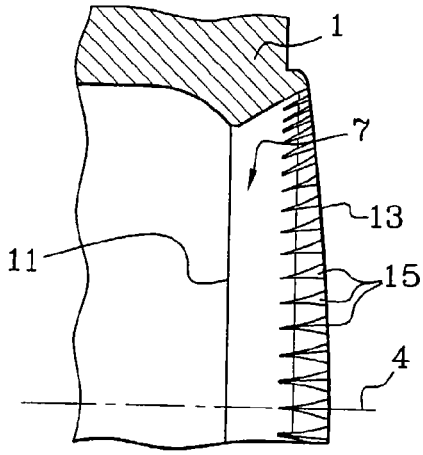
FIG. 7 represents a horizontal sectional view of an enlarged portion of the atomizer equipped with striations.

This arrangement at the level of the trailing edge 13 of the nozzle makes it possible to establish a hollow jet which presents an asymmetry of rotation as shown in FIG. 5. FIG. 5 shows the nozzle 1 in perspective and illustrates the hollow jet by showing its sweep in a plan P which is perpendicular to the axis 4 of the nozzle.

This hollow jet exhibits a form varying from an ellipse to a form having the outline of a knucklebone.

This asymmetry at the level of the trailing edge 13 is obtained as shown in FIG. 3, by means of a flattening of the downstream extremity of the nozzle according to two planes forming a dihedron, the crest 14 of this dihedron being arranged in the vertical plane Pv visible in FIG. 5, which plane Pv passes through the axis 4. The crest of this dihedron is constituted by the crests 14 visible in FIG. 5 at the level of the outlet of the nozzle 1.

The thickness of the film of water forming this hollow jet can be modulated by means of the valve 6, which valve is adjustable, controlled by means detailed hereafter; this valve also makes it possible to close the passage completely at the orifice 7.

Figure 8:
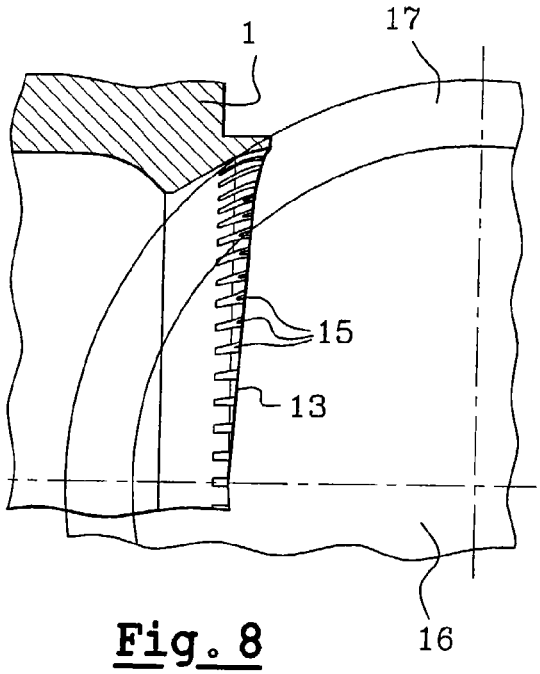
FIG. 8 represents the machining operation of the striations at the leakage edge of the atomizer, by means of a tool of the disk mill cutter type.
Figure 9:
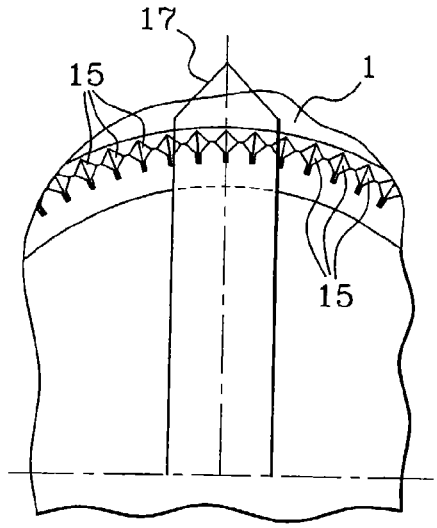
FIG. 9 represents a portion of the atomizer, seen from the front, with the striations forming tool.
Figure 10:
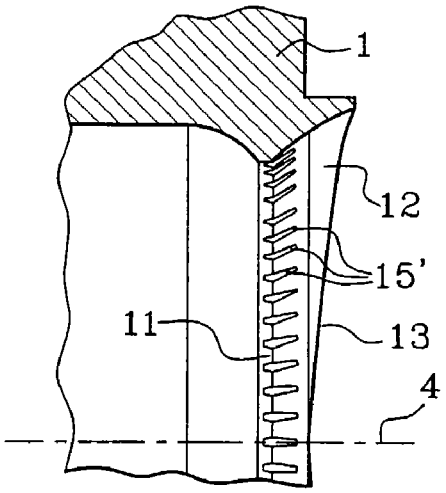
FIG. 10 represents a variant of the embodiment of the FIGS. 6 to 9, and in particular a vertical sectional view of the atomizer showing the striations arranged at the neck of the nozzle.
Figure 11:
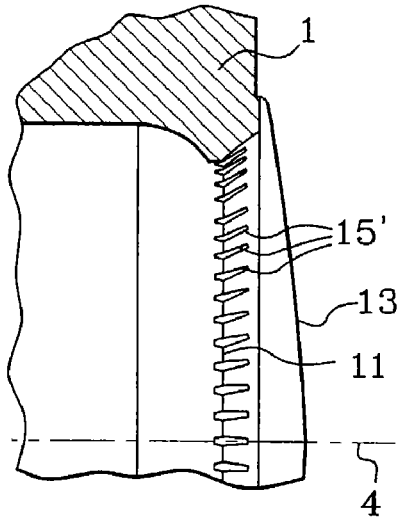
FIG. 11 is a horizontal sectional view showing the striations arranged at the neck of the atomizer.
Figure 12:
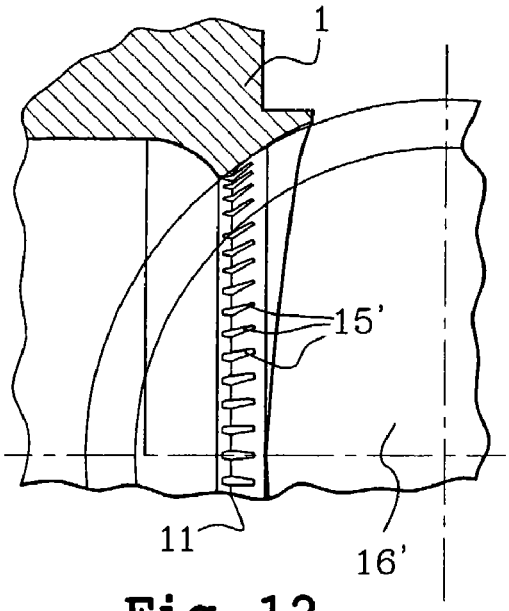
FIG. 12 illustrates the operation by which the striations are formed at the neck of the atomizer by means of a small diameter disk milling cutter.
Figure 13:
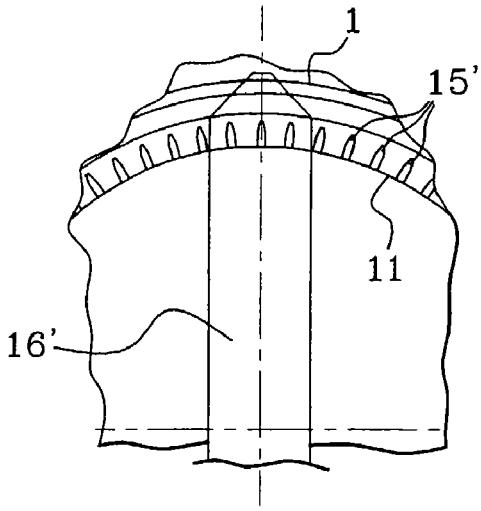
FIG. 13 is a partial front view of the atomizer also showing the tool for forming the striations.

The following FIGS. 6 to 13 show a particular arrangement of the surface shaping the jet at the level of the orifice 7. On FIGS. 6 and 7 striations 15 are observed at the level of the trailing edge 13 of the nozzle 1. These striations 15 are made, as shown in FIGS. 8 and 9, by means of a milling cutter 16 in the form of a disk, the cutting part 17 of which has a working section in the form of a V with an angle of 90° for example.

The striations 15 have a V-shaped profile; this profile makes it possible to extend the surface of the jet at the outlet of the nozzle and consequently to improve the exchanges between the water and the surrounding air.

These striations are regularly distributed over the entire surface of the nozzle, at the level of the trailing edge 13. They are arranged with an angular spacing included between 2 and 10°, of the order of 5° for example.

The depth of these striations varies as a function of their position on the outlet. In the horizontal plane, these striations are relatively modest whereas in the vertical plane they are, on the contrary, considerable.

The FIGS. 10 to 13 represent a variant of the embodiment of the striations. The corresponding striations 15' are this time arranged at the level of the neck 11 of the nozzle, on both sides of this neck. These striations 15' are obtained as previously by means of a milling cutter 16' of the small diameter disk type in order to be able to penetrate into the orifice of the nozzle and indent this nozzle up to the level of the neck 11.

These striations 15' are on both sides of the neck 11 and make it possible to set up a very low flow rate at the nozzle, under the effect of the valve 7; they also make it possible to avoid complete closure of the outlet channel.

The striations 15' have the same form over the entire circumference of the neck 11 and are arranged as previously with an angular spacing of 2° to 10°, of the order of 5° for example.

The striations 15' extend for ⅓ or ¼ upstream of the neck 11 and for the remainder downstream into the truncated part A of the atomizer 12.

FIG. 14 shows a spraying device according to the invention comprising two nozzles 1 inclined with respect to each other, forming an ejection angle which varies from 60° to 100°, for example of the order of 80°.

These nozzles 1 are arranged on the body 2 of the device, which body is for example made of a light alloy with channels for feeding the said nozzles with water under pressure and channels for feeding, in addition, nucleation means 20 with air under pressure, which nucleation means spray a finely dosed mixture of water and air which rapidly forms in the ambient air ice crystals for seeding the principal jet at the outlet of each of the nozzles 1.

The device shown in FIG. 14 comprises two pairs of nucleation means; each nozzle 1 comprises in fact two nucleation means, one of which is arranged above the said nozzle and the other below. These nucleation means 20, for example such as described in the document WO-99/00258, spray their mixture on either side of the hollow jet and in particular in the flattened and hollow zone of this jet such as it appears on FIG. 5.

The spraying device is installed on a support 21 of the type which is described in the document FR-2 743 872.

This spraying device also comprises means which make it possible to control the valves 6 arranged in the orifice 7 of the nozzles 1.

These valves make it possible to control the flow rate of each nozzle and are controlled simultaneously.

The means of control of the valves, detailed in the following Figures, are arranged within a housing 22 which caps the upper back part of the device and which is fixed to the body 2 by the screw 23.

Figure 15:
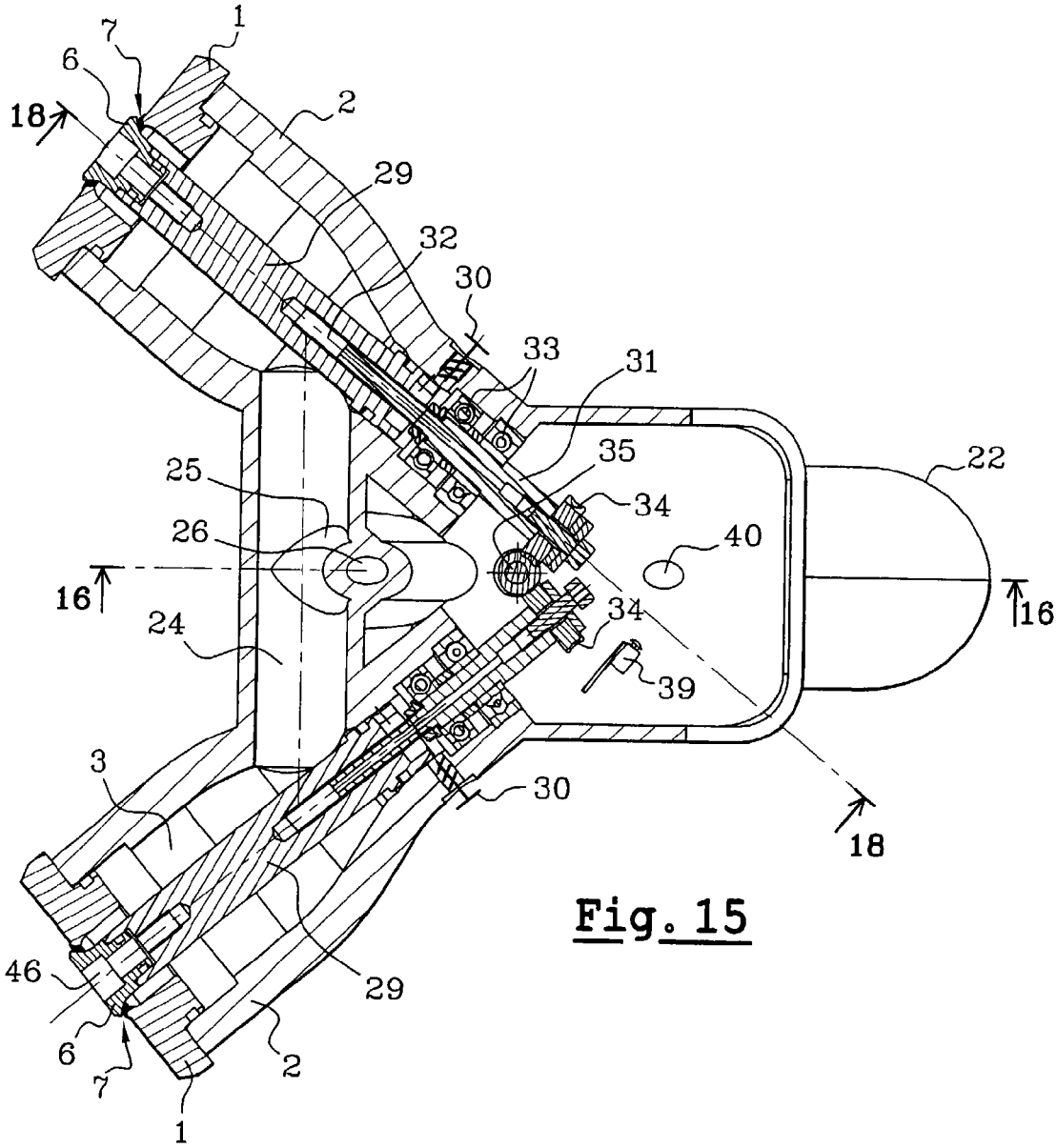
FIG. 15 is a diametric section of the spraying device, which section is located at the level of the axes of the nozzles.

FIG. 15 is a sectional view of the spraying device along a plane which passes through the axes 4 of the nozzles.

Figure 16:
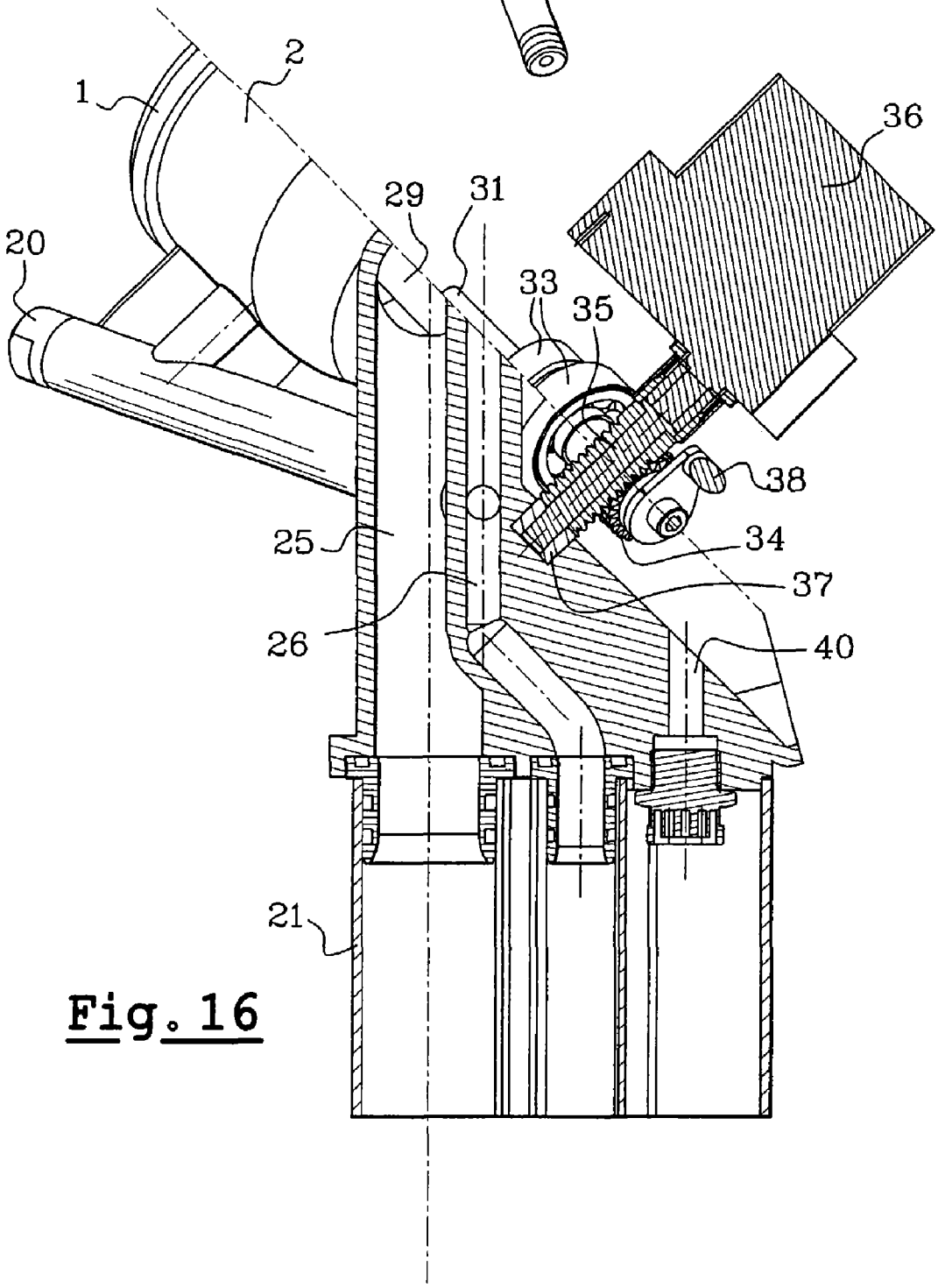
FIG. 16 is a vertical section along the central vertical plane of the spraying device marked 16—16 on the preceding figure.

The body 2 of the spraying device, made as previously indicated of light alloy, comprises the chambers 3 which serve to feed each of the nozzles 1, which chambers are themselves fed by a transverse channel 24 which communicates by a duct 25 with the support as shown in FIG. 16.

In parallel to the duct 25 there is a duct 26 through which circulates air under pressure which serves to feed the nucleation means 20.

The valves 6 arranged at the level of the orifice 7 of the nozzles 1 are mounted on shafts 29 which are longitudinally adjustable in the body 2; these shafts 29 are prevented from rotating by stud type screws 30, schematized in FIG. 15.

The shafts 29 are controlled by means of the screw 31. The upstream extremity of each shaft 29 comprises a threaded drill hole 32. The screws 31 are mounted with rotation in the body 2 by means of rolling mechanisms 33 for example and they comprise at their upstream extremity a toothed wheel 34.

The two toothed wheels 34, corresponding to the control screw 31 of each of the valves 6 are geared with an endless screw 35 which is motorized by conventional means of the geared motor type 36. This geared motor 36, which appears in FIG. 16, is housed in the housing 22, fixed by any appropriate means to the body 2.

It is shown in FIG. 16 that the motorized endless screw 35 is lodged at its extremity in a bearing 37 arranged in the body 2 of the device.

The electrical supply of the geared motor 36 is provided by a wiring system not shown which passes through the orifice 40 arranged in the body 2, this orifice 40 corresponds to one of the channels of the support 21.

A position control device for the toothed wheels constituted for example by an indicator 38 as shown in FIG. 16 makes it possible, in cooperation with appropriate means 39, to control the position of the valve 6 in the orifice 7 of the nozzle 1.

Figure 17:
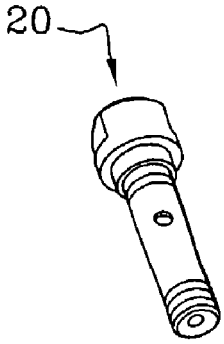
FIG. 17 shows a nucleation means such as installed above one of the nozzles.

FIG. 17 is a perspective view of a nucleation means 20 which exists in the form of a cartridge screwed into an appropriate drill hole of the body 2. This cartridge receives at its upstream extremity the air under pressure which originates from channel 26 and it receives water under pressure originating from the chambers 3 which serve to feed the nozzles 1.

The water under pressure penetrates radially into a mixing chamber of the nucleation means and at the outlet of the latter the air-water mixture causes the formation of ice crystals when the temperature is adequate.

Figure 18:
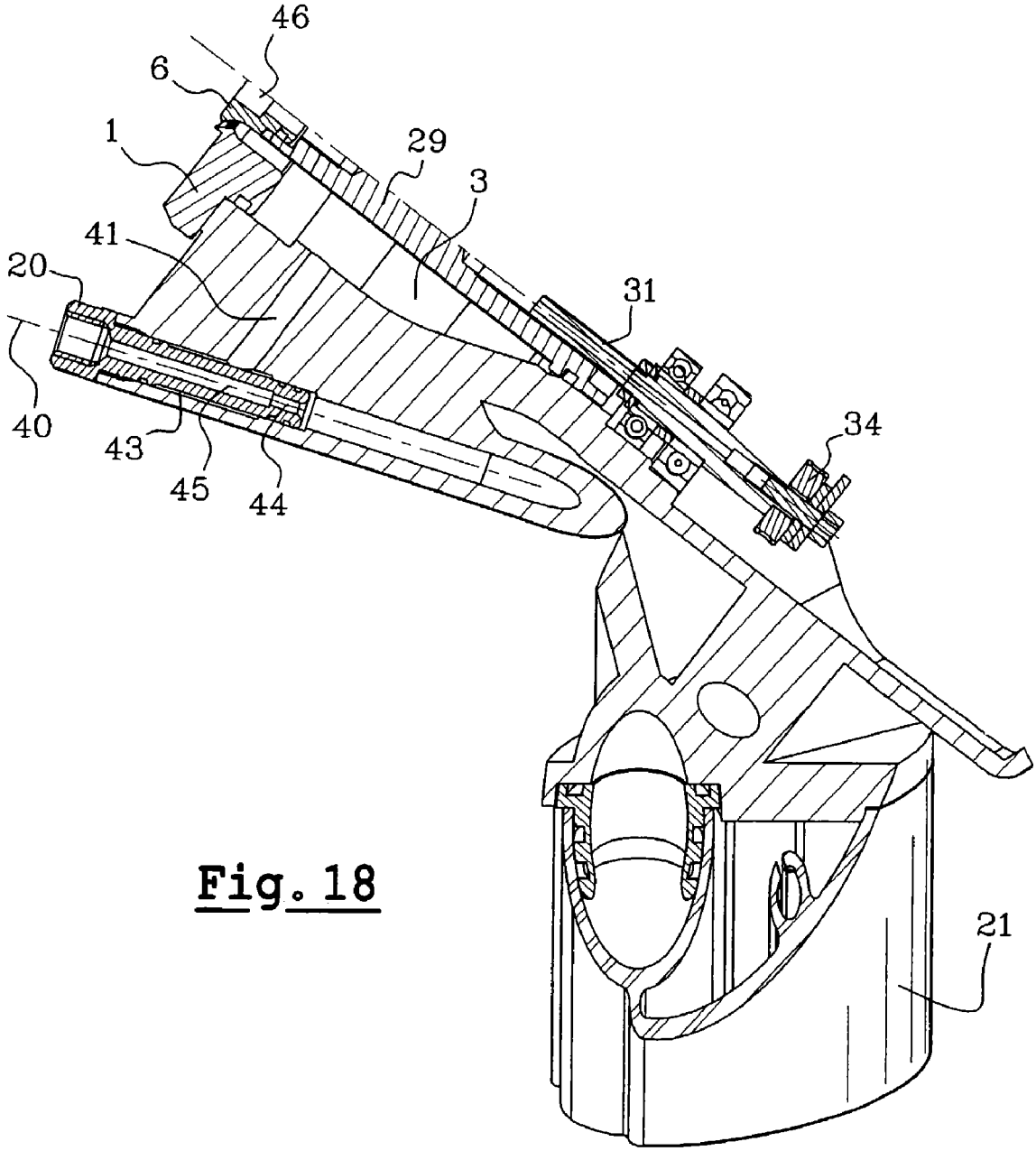
FIG. 18 is a partial view of a vertical section passing through the axis of a nozzle of the spraying device.

FIG. 18 which is a partial section along a vertical plane, passing through the axis 4 of the nozzle and through the axis 40 of a nucleation means 20 shows among other things the channel 41 which extends between the feeding chamber 3 of the nozzle and chamber 43 which envelops the nucleation means 20.

The inlet orifice 44 of the nucleation means 20 for air under pressure has a diameter appreciably less than that of the mixing chamber 45 of the nucleation means.

In FIGS. 15 and 18 it can be seen that the valve 6 exists in the form of a part attached to the upstream extremity of the shaft 29. This valve 6 is for example fixed by means of a screw 46 to the extremity of the control shaft 29.

This constructive arrangement makes it possible to use different materials for the parts in question and in particular a hard material such as steel for the valve 6 which is subject to erosion owing to the passage of water under pressure.

What is claimed is:

1. Spraying device for water under pressure comprising: a tubular body which defines a chamber (3) connected to a supply of water under pressure, a nozzle (1) arranged at the outlet of said chamber (3) and equipped with an orifice (7) forming an atomizer (12) which extends from the neck of said nozzle and a constriction organ in the form of a valve (6) that is arranged in the orifice (7) of said nozzle in order to form a hollow, thin-walled jet, wherein said orifice (7) comprises an external surface shaping the hollow jet, which is arranged to produce an asymmetry of rotation around the ejection axis (4).

2. Spraying device according to claim 1, further comprising at the level of the surface shaping the hollow jet, grooves (15, 15') which are oriented according to a plane passing through the axis (4) of the nozzle, these grooves are arranged either at the level of the trailing edge (13) of said nozzle or at the level of the neck (11).

3. Spraying device according to claim 2, wherein the grooves (15, 15') are positioned with an angular spacing varying from 2° to 10°.

4. Spraying device according to claim 2, wherein the grooves (15, 15') have an axial length such that they make it possible to maintain a leakage flow rate when the valve (6) is in the active closure position.

5. Spraying device according to claim 2, further comprising grooves (15, 15') made by means of a disk type milling cutter (16, 16'), the periphery of which forms an angle of 90°, this milling cutter is positioned in a plane passing through the axis of the nozzle.

6. Spraying device for water under pressure comprising: a tubular body which defines a chamber (3) connected to a supply of water under pressure, a nozzle (1) arranged at the outlet of said chamber (3) and equipped with an orifice (7) forming an atomizer (12) which extends from the neck of said nozzle and a constriction organ in the form of a valve (6) that is arranged in the orifice (7) of said nozzle in order to form a hollow, thin-walled jet, wherein said orifice (7) comprises a surface shaping the hollow jet, which is arranged to produce an asymmetry of rotation around the ejection axis (4), wherein the surface shaping the jet comprises a truncated part A which extends from the neck (11) of the nozzle (1) and which is followed by a discharge surface B, the angle of which in the axial longitudinal plane of the said nozzle changes in accordance with a non-linear profile diminishing from upstream to downstream, and the axial length of which varies between a value zero or essentially zero with, at this location, a jet the outlet angle of which corresponds to the angle of the said truncated part, and a value of the order of several millimeters, adapted to the choice of the outlet angle desired for the said jet, this angle being less than the angle of the truncated part A.

7. Spraying device according to claim 6, wherein the aperture angle of the hollow jet varies from a value H which is of the order of at least 60° and a value V which may be less than 20°.

8. Spraying device for water under pressure comprising: a tubular body which defines a chamber (3) connected to a supply of water under pressure, a nozzle (1) arranged at the outlet of said chamber (3) and equipped with an orifice (7) forming an atomizer (12) which extends from the neck of said nozzle and a constriction organ in the form of a valve (6) that is arranged in the orifice (7) of said nozzle in order to form a hollow, thin-walled jet, wherein said orifice (7) comprises a surface shaping the hollow jet, which is arranged to produce an asymmetry of rotation around the ejection axis (4), further comprising two nozzles (1) which are connected to corresponding chambers (3) fed with water under pressure, these nozzles (1) are centered in the same plane and form between them an angle which is included between 60° and 100°, means for the simultaneous control of the valves (6) of said nozzles making it possible to vary at will the flow of the water to be sprayed under pressure.

9. Spraying device according to claim 8, further comprising valves (6) adjustable by means of a screw nut system, each valve comprising a part acting as a nut, adjustable by means of a screw (31), this valve (6) being prevented from rotation by appropriate means and each adjustable screw (31) being equipped with a toothed wheel (34) which is geared to the same motorized endless screw (35), this motorized screw making possible the simultaneous control of the two valves (6).

10. Spraying device according to claim 8, further comprising a single-piece body (2) equipped with drill holes forming the chambers (3) supplying water under pressure, these chambers are arranged to receive the spraying nozzles (1), said body (2) being also equipped with drill holes for the installation of nucleation means (20) fed with water under pressure at the same time as the nozzles (1), and with air under pressure, these nucleation means (20) being present in the form of cartridges screwed to the extremity of the drill holes.

* * * * *